US009558639B2

(12) United States Patent
Modi et al.

(10) Patent No.: US 9,558,639 B2
(45) Date of Patent: Jan. 31, 2017

(54) SYSTEMS AND METHODS OF INTRUSION DETECTION

(71) Applicant: Google Inc., Mountain View, CA (US)

(72) Inventors: Yash Modi, San Mateo, CA (US); Kevin Charles Peterson, San Francisco, CA (US); Mark Rajan Malhotra, San Mateo, CA (US); Sourav Dey, South San Francisco, CA (US); Lawrence Au, Sunnyvale, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/585,295

(22) Filed: Dec. 30, 2014

(65) Prior Publication Data

US 2016/0189496 A1 Jun. 30, 2016

(51) Int. Cl.

| | |
|---|---|
| ***G08B 13/08*** | (2006.01) |
| ***G08B 13/00*** | (2006.01) |
| ***G08B 25/00*** | (2006.01) |

(52) U.S. Cl.

CPC ..... *G08B 13/08* (2013.01); *G08B 13/00* (2013.01); *G08B 25/008* (2013.01)

(58) Field of Classification Search

CPC ..... G08B 13/08
USPC ..... 340/545.2
See application file for complete search history.

(56) References Cited

U.S. PATENT DOCUMENTS

| | | | | |
|---|---|---|---|---|
| 7,403,109 | B2 | 7/2008 | Martin | |
| 7,978,069 | B2 | 7/2011 | Wu | |
| 8,510,255 | B2 | 8/2013 | Fadell et al. | |
| 2001/0048030 | A1 | 12/2001 | Sharood et al. | |
| 2004/0032326 | A1 | 2/2004 | Nakamura et al. | |
| 2004/0145458 | A1* | 7/2004 | DiCroce | B60R 25/1003 340/426.1 |
| 2006/0181401 | A1 | 8/2006 | Martin et al. | |
| 2007/0063840 | A1 | 3/2007 | Jentoft et al. | |
| 2007/0220907 | A1 | 9/2007 | Ehlers et al. | |
| 2007/0247302 | A1* | 10/2007 | Martin | G08B 25/008 340/506 |
| 2008/0068162 | A1* | 3/2008 | Sharma | G08B 25/008 340/545.1 |
| 2008/0094203 | A1 | 4/2008 | Kogan et al. | |

(Continued)

FOREIGN PATENT DOCUMENTS

| | | | | |
|---|---|---|---|---|
| DE | 3701136 | A1 * | 10/1988 | G08B 13/00 |
| DE | 102013103535 | * | 10/2014 | G08B 29/18 |

(Continued)

OTHER PUBLICATIONS

International Search Report and the Written Opinion of the International Searching Authority for PCT/US2015/061155 dated Feb. 9, 2016.

(Continued)

*Primary Examiner* — Juan A Torres

(74) *Attorney, Agent, or Firm* — Morris & Kamlay LLP

(57) ABSTRACT

Systems and methods of the disclosed embodiments provide a sensor to detect a side from which a door or window is being opened, and a controller communicatively coupled to the sensor to determine the side from which the door or window is being opened, and to generate a security exception based on the determination of the side from which the door or window is being opened.

22 Claims, 8 Drawing Sheets

(56) References Cited

U.S. PATENT DOCUMENTS

| | | | | |
|---|---|---|---|---|
| 2008/0157964 | A1 | 7/2008 | Eskildsen et al. | |
| 2008/0238669 | A1* | 10/2008 | Linford | E05B 45/06 340/542 |
| 2009/0140056 | A1 | 6/2009 | Leen et al. | |
| 2010/0127854 | A1 | 5/2010 | Helvick et al. | |
| 2011/0046805 | A1 | 2/2011 | Bedros et al. | |
| 2012/0186774 | A1 | 7/2012 | Matsuoka et al. | |
| 2013/0173064 | A1 | 7/2013 | Fadell et al. | |
| 2013/0245838 | A1 | 9/2013 | Zywicki et al. | |
| 2013/0338839 | A1 | 12/2013 | Rogers et al. | |
| 2014/0191862 | A1 | 7/2014 | Haines | |
| 2014/0266669 | A1 | 9/2014 | Fadell et al. | |
| 2014/0313032 | A1 | 10/2014 | Sager et al. | |
| 2015/0308178 | A1* | 10/2015 | Warren | E05F 15/70 700/275 |

FOREIGN PATENT DOCUMENTS

| | | | |
|---|---|---|---|
| DE | 102013103535 | A1 | 10/2014 |
| EP | 1713045 | A2 | 10/2006 |
| EP | 2393071 | A2 | 12/2011 |

OTHER PUBLICATIONS

Notification of Transmittal of the International Search Report and The Written Opinion of the International Searching Authority for PCT/US2015/067366, dated Apr. 21, 2016.

* cited by examiner

SYSTEMS AND METHODS OF INTRUSION DETECTION

CROSS-REFERENCE TO RELATED APPLICATIONS

This application is related to U.S. application Ser. No. 14/585,223, filed Dec. 30, 2014, the disclosure of which is incorporated by reference in its entirety.

BACKGROUND

In traditional home security systems, if the security system is armed while the home is occupied, an occupant exiting the house may set off the alarm. That is, the alarm of the home security system may sound when the occupants do not want it. Another unwanted alarm event in typical home security systems occurs while the alarm device of the home security system is armed in a stay mode, e.g., during nighttime when the perimeter of the home may be alarmed but the interior is not. If an occupant opens a window or an exterior door for ventilation, the alarm can be activated, even when the window or door is opened from the inside of the house. Again, this scenario generates an unwanted alarm event with traditional home security systems, and can deter a user from opening, for example, a window of the home when the user desires. The unwanted alarm events can also deter the user from using or arming the alarm of the home security system when it should be used. Additionally, depending on the home security system configuration, setting off of the alarm unintentionally could contact a security system provider or law enforcement unnecessarily.

BRIEF SUMMARY

According to an embodiment of the disclosed subject matter, a system may be provided that includes a sensor to detect a side from which a door or window is being opened, and a controller communicatively coupled to the sensor to determine the side from which the door or window is being opened, and to generate a security exception based on the determination of the side from which the door or window is being opened.

According to an embodiment of the disclosed subject matter, a method may include detecting, by a sensor, a side from which a door or window is being opened, determining, by a controller communicatively coupled to the sensor, the side from which the door or window is being opened, and generating, by the controller, a security exception based on the determined side from which the door or window is being opened.

According to an embodiment of the disclosed subject matter, means for detecting an opening of a door or window are provided that includes detecting, by a sensor, a side from which a door or window is being opened, determining, by a controller communicatively coupled to the sensor, the side from which the door or window is being opened, and generating, by the controller, a security exception based on the determined side from which the door or window is being opened.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1A:
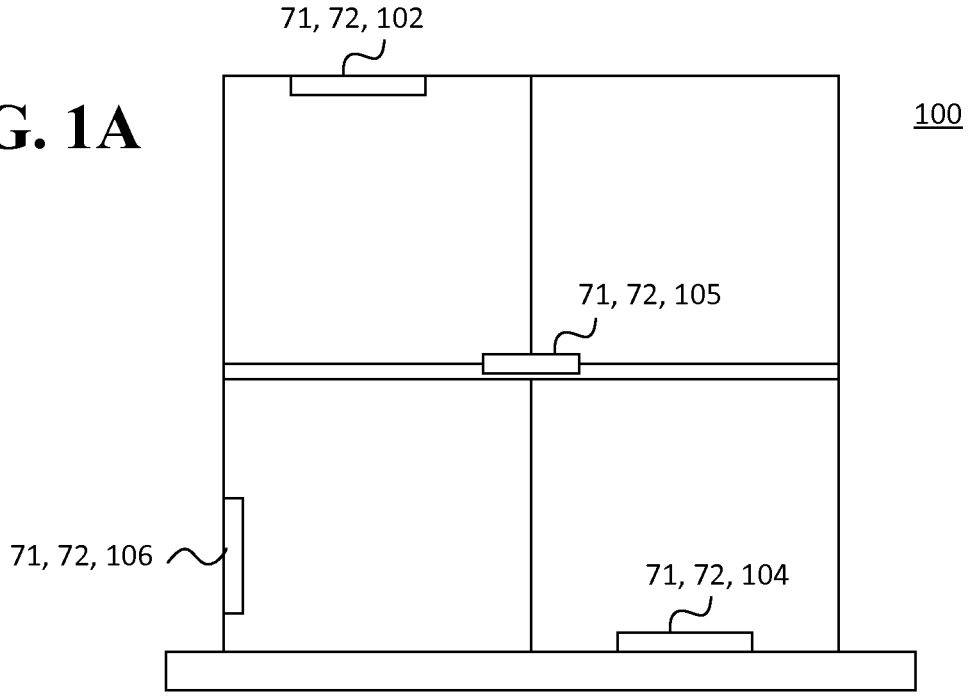
FIGS. 1A-1C show example positions of window sensors according to embodiments of the disclosed subject matter.

When a window or door is opened from the interior of a home, it is generally less likely to correspond to an intrusion than when opened from the outside. Embodiments of the disclosed subject matter include a security system that uses data from at least one sensor to determine whether a window or door is being opened from the inside or the outside of a home or building. A smart-home environment having a security system can respond to the opening of the door or window based on the results of this determination. For example, when the system determines that a window is opened from the inside, no notification message may be sent or displayed to a user, and no alarm may be sounded.

In some embodiments of the disclosed subject matter, the security system may provide low intrusion notifications of action. For example, a sensor of the system may detect that a window is opened from the inside in a master bedroom of a home, and the system may provide a notification of the opening via a display, a notification message (e.g., an awareness notification) that is transmitted to a user device (e.g., a smartphone, a wearable computing device, a table computer, or the like), and/or a device light output (e.g., on a control panel, on a device such as a smoke detector in the occupied rooms of the house, or the like). The awareness notifications can be provided when the security system is armed (e.g., operating in a home mode, stay mode, or the like) or in disarmed state, and can be actionable. For example, the awareness notification message may provide an option to launch an application with video (e.g., an application stored on a smartphone, tablet computer, or the like) of the affected room can be presented to the user, and/or an option to output an audio and/or visual alarm, and/or call a security monitoring company or emergency response service (e.g., police department, fire department, or the like).

That is, the in examples above, the one or more sensors that detect that the window is open from the inside may be infrared (IR) sensors. The one or more IR sensors may detect motion in the room of the home where the window is located, and may detect motion of the window itself. The location of the sensors detecting the data may be known to the security system (e.g., the location information may be pre-stored by the system, may be selected and/or provided at installation and/or initialization of the system, and/or may be provided by the sensors), such that the system may identify the location of the open window to the user.

When the notification message is provided, an option to launch the application with video of the affected room can be presented to the user, where the video is captured by a camera sensor that may be separate and/or included with the IR sensor, and/or an option to output an audio and/or visual alarm, and/or call a security monitoring company or emergency response service can be provided.

When the system determines that a window is being opened from the outside, it may generate a notice or an alarm, depending on the security state of the system. For example, if the system is in a "home" mode (e.g., the occupants are at home, and are active within the home), then no alarm may be generated. When the system is in the "away" mode (e.g., the home is unoccupied), then the system may generate a notice and/or alarm upon detecting an opening and determining that it was made from the outside.

The position of a person opening a window or door can be determined by one or more sensors in the smart home. For example, an object detection sensor package can be affixed to a window or a location near the window. An object detection package can include a signal generator (e.g., a sonic or infrared signal generator) and a sensor (e.g., a sonic or infrared sensor). The object detection package can be oriented to send a signal in a specific or general direction, such as towards an area outside the window or to an area inside the window. The signal can be generated and sent periodically, such as once a second, once every ten seconds, etc. In an implementation, the signal can be generated and sent in response to the detection of movement (e.g., opening) of the window. The sensor can receive a reflection of the signal from an object (a response signal), such as a person who is opening the window.

In an implementation, the sensor package can be calibrated and/or configured (e.g., initially baselined) or reset (e.g., to a baseline) at a time during which there is no person opening the window from the outside. When the response signal is received, it can be compared to the baseline. If the response signal differs from the baseline, the system can determine that there is a person (or other object) outside the window, for example when the window is being opened. The response signal can be further analyzed by the system to determine the proximity, velocity and/or acceleration of the person or object. The security system can receive data from the sensor package and determine from which side a window or door is being opened.

The sensor package may include a camera and/or wireless communication interface to determine the identity of a person opening a door or window. For example, image data of the person may be captured. The security system may receive this example of identification data and use technology such as facial recognition technology or otherwise compare at least a portion of the captured image data with pre-stored image data of persons registered with the security system (e.g., home occupants, relatives, friends, or the like). The security system may thus determine the identity of a person opening a window or door based on the date received from the sensor package.

In the embodiments of the disclosed subject matter, identification of any person is optional for the security system. That is, to activate the person identification functionality of the security system, a user may need to affirmatively select this option. In the embodiments disclosed herein, the user may need to affirmatively activate any feature of the security system that detects, collects, stores, or transmits personal information or the like. In some embodiments, the user may select that the security system transform the collected data so as to make the identity of a person anonymous, and/or any detected behavior (e.g., days and times that a person leaves or enters a home, or the like) be anonymous.

The security system may change its mode based on the determined side from which a window or door is being opened. For example, if the door or window is opened from the inside, the system may refrain from outputting a notification message and/or an alarm. Notification messages may include information detected from the window or door sensors, which may include the location of the door or window being opened. As discussed throughout, the notification message may include an option for a user to launch an application with video (e.g., an application stored on a smartphone, tablet computer, or the like) of the room in which the opening of the door or window is detected, and/or an option to output an audio and/or visual alarm, and/or call a security monitoring company or emergency response service (e.g., police department, fire department, or the like).

In some embodiments, such as when person identification features are selectively configured in the security system, the identity of a person opening the window or door can be determined, and the mode of the system may change according to the determined identity. For example, the system may change from an away mode to a home mode when a person is identified as an authorized user opening the door or the home from the outside. Notification messages may be transmitted and/or an alarm may be output when the person opening the door or window is not identifiable by the system or is identified by the system as an unwelcome person, for example using a blacklist of unwelcome person's image data. Notification messages may include information detected from the window or door sensors, which may include the location of the door or window being opened. The notification message may include an option for a user to launch an application with video of the room in which the opening of the door or window is detected, and/or an option to output an audio and/or visual alarm, and/or call a security monitoring company or emergency response service.

Alternatively, or in addition, the wireless communication interface may be used to acquire identification information from a smartphone, wearable computing device, RFID device, key FOB, or the like from a person opening a window or door. Similar to the acquisition of image data, the system may change operating modes, transmit a notification message, and/or output an alarm based on the acquired identification information and information about the side from which the window or door is being opened.

In an implementation, the system may determine that the window is being opened from the outside based on the determination that there is a person outside of the window at or around the same time the window is opening. The system may then take an action based on this latter determination and possibly also based on the present mode, such as away or home. In an implementation, if a window is being opened from the outside and the system is in a home mode, no action may be taken. In another implementation, if the system is in home mode, a notice can be sent to a smartphone or other computing device of a user. In yet another implementation, an audible announcement can be made announcing that a window is being opened. In an implementation, the announcement can identify the location of the window being opened.

If the system is in away mode, then it can generate a notice based on the determination that the window is being opened from the outside. The notice may be a notification to a security company or a police department indicating a possible intrusion. The notice may also include a text, email or telephone message sent to a smartphone of a user of the system, such as an owner of the home. This action can also be made dependent on identification information received about the person from one or more sensors. When an identification option is selected when the security system is configured, the system may identify the person opening the window and select an action to be take based on the identity, the side from which the window is being opened (e.g., the outside), and the present security state of the system. In another implementation, the security state of the home may be changed to a higher alert status, even if no message or alert is sent.

Data may be aggregated and analyzed from multiple sensors to improve the confidence in a determination that window or door is opening and the side of the window from which it is being opened (inside or outside). For example, the security system may detect and/or process events that occur before and after an opening is detected. When the controller of the security system aggregates data from events detected before and/or after a detected opening event, the security system may more accurately determine whether the opening event has been detected, whether the opening was made from the outside or inside of a premises and whether an alarm device should be activated (e.g., an audio and/or visual alarm should be output) in response to the detected opening event (e.g., when the opening event is an external event).

For example, a system can examine data from camera sensors collected shortly before an opening is detected. Such data can be recorded in a buffer or other memory of the security system so that historical data can be used in making determinations. When a door sensor indicates that the door is being opened, camera data covering the areas inside and outside the door may be analyzed along with geofence data based on the location of mobile devices registered to the regular occupants of the home and to approved guests and service providers. If the object sensor data over time initially indicates no object on either side of the door and then an object is present on the outside, the camera sensor indicates a known occupant of the house, and geofence data shows that same person's mobile device within an area proximate to the home, all of this information can be taken together by the system to improve confidence in the determination that an authorized person is accessing the home.

In an implementation, a smart doorknob can be installed on the door. The smart doorknob can detect which handle is being actuated to open the door and thereby provide an indication as to whether the opener is on the inside or the outside.

Implementations of the disclosed subject matter can make exceptions to sending a notice or generating another event in response to a window or door being opened from the outside, even if the security state is elevated, e.g., set to an "away" mode. For example, if the system is optionally configured to attempt to identify persons, the system can determine the likely identity of a person opening an exterior door from the outside is an authorized guest by detecting a key FOB known to belong to the person. Alternatively, or in addition, the system can determine the likely identity of a person opening an exterior door from the outside is an authorized guest by detecting smartphone, wearable computing device, and/or RFID device known to belong to the person when the system is optionally configured to determine an identity of a person. Confidence in this determination can be further bolstered by using data from a camera pointed at the exterior of the door with facial recognition technology to confirm the identity of the person outside the door. Rather than require the entering person to key in a code to change the security state (e.g., the operation mode) from an away mode to a home mode to avoid an alarm being dispatched, the system can make an exception and automatically transition its operation state from an away mode to a home mode. The criteria for generating such an exception can be set as appropriate for each situation. For example, making an exception (don't sound the alarm and transition from away to home, as opposed to sound the alarm) may take place only with a certain level of confirmation and confidence in the determined identity of the person. For example, the exception may require that indications from three different sensors (e.g., a camera, geofence data and key fob data), or two different sensors, etc. In another example, the security system may be in a "vacation" mode, e.g., when the occupants are away from the house for a period of time, such as 1 day, 3 days, 5 days, 1 week, 2 weeks, 1 month, or the like. If the system determines that a person is opening an exterior door from the outside and the person is identified by the system (e.g., when the system is selectively configured to identify persons) to be one of the occupants (and especially a principal occupant, such as the owner), then the system may automatically transition from vacation mode to home mode rather than sound an alarm. This can be especially useful in avoiding a false alarm when an occupant returns to the home early from a vacation.

Yet another kind of exception can apply to a particular set of windows and/or doors. The default may be to transmit and/or display a notification message and/or output an alarm when an exterior door or a window is opened from the outside and the system is set to away mode. A controller can set and/or designate one or more specific doors, windows, and/or entryways (or type thereof, such as sliding glass doors, double hung windows, etc.), and the like that may be opened from the outside without triggering an alarm even when the system is in an away mode, for example. This configuration can be used, for example, when a late arrival is expected though a given door and the present occupants wish to keep the rest of the home secured under a heightened security mode.

In some embodiments, the exceptions may be limited by number. In other words, a given door can be excepted from triggering an alarm even when opened from the outside, but only one time, or a limited number of times. If the exception only applies once, the second time the door opened from the outside, an alarm may sound.

Likewise, when the system is selectively configured to identify persons, the exception may be specific to a particular person, persons or type of person. Thus, if a person identified as an occupant opens a door from the outside after the system is placed in a stay mode, the system may not sound an alarm, while a person other than an occupant may trigger the alarm. When a person is identified as emergency services personnel (e.g., when carrying an emergency services key FOB, or when carrying a smartphone, wearable computing device, RFID tag, or the like having data which identifies the person as being from emergency services), the alarm may not be output and/or a notification message may not be transmitted and/or displayed. A person or type of person may be identified by the system communicating with the person's smartphone, a smart wearable such as a watch, an RFID carried by the person, and so on (e.g., via a sensor that is positioned so as to communicate with the person's device. When the person is identified, the system the alarm may not be output and/or a notification message may not be transmitted, or a different message may be transmitted (e.g., an alert to a user containing the name of the identified person entering the premises.) In an example, a sensor of the system may identify the person as someone who is expected to arrive at the home, such as a service provider (e.g., plumber, home remodeling professional, cable technician, or the like).

Time limits may be applied to an exception or to modulate the normal response based on the determination that a window or door is being opened from the outside. For example, a door may be opened from the outside without triggering a notice or alarm if it occurs during business hours, during daylight hours, during a given time period (e.g., preset time period), if the act of opening the door takes less than or more than a given opening time threshold, etc. These time periods can be changed in correspondence with one or more modes of the security state of the home. For example, in the home mode, no alarm may sound if a person opens a door from the outside during daylight hours but may sound if they open the door from the outside between the hours of midnight and six o'clock in the morning. On the other hand, the alarm may sound during daylight hours in away mode. In other words, the action taken by the system can depend on both time and mode. As discussed throughout, the action taken by the system may depend upon whether the person opening the door or window of the home or building is inside or outside, and whether the system has identified the person.

The preset time can be adjusted by a controller according to the user. For example, as discussed herein, the controller can aggregate data from the sensors to determine when a user enters and exits the home (e.g., the days and times for entry and exit, the doors associated with the entry and exit, and the like).

An exception may occur based on any combination of the foregoing kinds of criteria, as well as any other suitable criteria. For example, an exception may occur based on the side from which a door is being opened, the determined speed with which the door is opened, the determined identity of the opener (if the system is selectively configured to identify a person and/or if the identity cannot be determined), the mode of the security system at the time the door is opened, as well as historical data, such as past events involving the door or the premises. For example, an exception may be generated that permits a person to open a door from the outside without generating an alarm, provided the same identified person has entered the premises with the system in the same mode at least three times within the past two weeks.

Figure 1B:
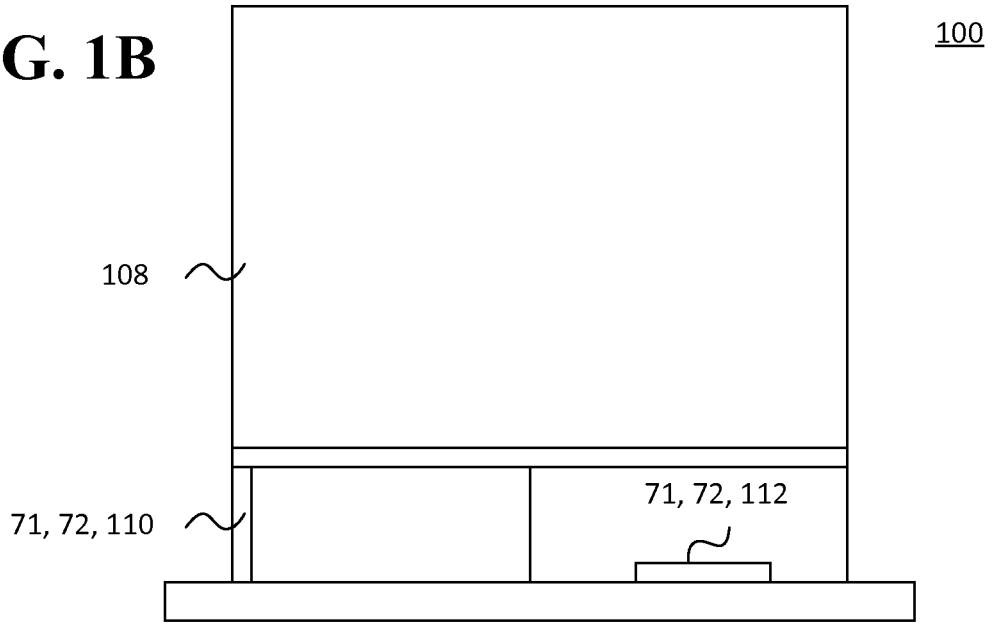
Figure 1C:
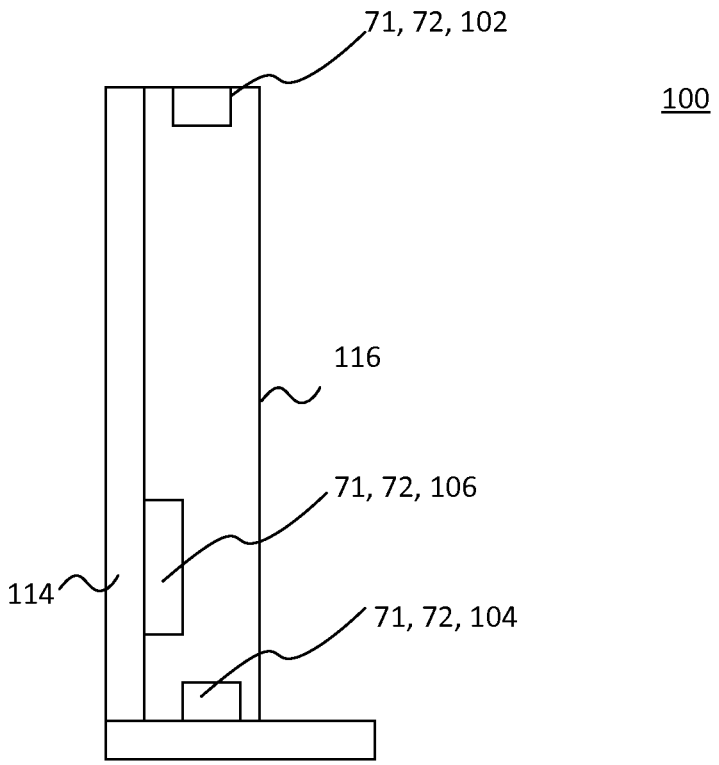

FIGS. 1A-1C show example positions of sensors that can be used according to embodiments of the disclosed subject matter. The sensors may be used to determine whether a window is being opened, and whether the window is being opened from the inside or the outside of the home or building. In some embodiments, when the system is selectively configured to determine identity, the window sensors shown in FIGS. 1A-1C may be used in combination with a camera sensor and/or a communication interface to determine the identity of the person opening the window (e.g., from image data captured from the person and/or identifying information from a device carried by the person). Such sensors may be disposed on the inside and/or outside of the window, or within a predetermined proximity to the window, on the inside and/or outside of the home or building having the window. That is, the camera and/or communication sensors may acquire images and/or data from a variety of suitable positions near the window. To more accurately detect the opening of a window, and the side (e.g., inside or outside) that the window is being open, FIGS. 1A-1C show examples of a different types and mounting locations of sensors to determine the opening of the window from the inside or outside.

FIGS. 1A-1C show window 100, having one or more sensors 71, 72, which may be mounted in one or more positions relative to the window 100. As shown in FIG. 1A, the sensors 71, 72 in position 102, may be mounted so as to be in a vertical positon, so as to be facing downward. The sensors 71, 72 may be mounted in position 104 so as to be in a vertical position as to be facing upward. The sensors 71, 72 in position 106 may be mounted in a horizontal position. The sensors 71, 72 may be mounted in position 105 to monitor a lock on the window 100. One of more of the sensors 71, 72 may be mounted in positions 102, 104, 105, and 106 to determine whether the opening of the window 100 is from inside the home or building, or from the outside. Although sensors 71, 72 are shown as mounted in positions 102, 104, 105, and 106 in FIG. 1A, these are merely examples of the number of sensors and mounting positions for the window 100 that may be used. For example, one sensor may be mounted (e.g., mounted in position 106), or two sensors may be mounted, such as in positions 104 and 106.

In some embodiments, to more accurately detect whether the opening of the window 100 is from the inside or the outside, sensors may be mounted in one or more positions adjacent to the window and/or within a predetermined distance from the window. For example, the sensors may be motion sensors, and may detect motion within a predetermined area from the window. This sensor data, along with the data from the sensors mounted on the window as shown in FIG. 1A (e.g., that detect motion of the window 100), may be used by the security system to determine whether the window is being opened from the inside or the outside.

As shown in FIG. 1B, the window 100 may have a window treatment 108, which may be mounted so as to cover the window 100. For example, the window treatment 108 may be a shade (e.g., roller shade, Roman shades, and the like), horizontal blinds, vertical blinds, drapes, or the like. When the window treatment 108 is arranged so as to cover and/or partially cover the window 100, the window treatment 108 may interfere with the sensors 71, 72 to detect an opening event. Accordingly, when a window 100 has a window treatment 108, the sensors 71, 72 may be mounted so as to maximize the ability of the sensors 71, 72 to detect an opening event when the window 100 has a window treatment 108 in any position. For example, as shown in FIG. 1B, if the window 100 has a window treatment 108, the number, selection, and mounting position of the sensors 71, 72 may be selected so that a window opening event may be detected. For example, as shown in FIG. 1B, two sensors (e.g., sensors 71, 72) may be mounted in positions 110 and 112. That is, one of the sensors 71, 72 may be mounted at position 110 in a horizontal orientation near the base of the window 100, and another of the sensors 71, 72 may be mounted at the base of the window 100 in a vertical position so as to face upward. Although not shown in FIG. 1B, a sensor (e.g., sensor 71, 72) be mounted at position 105 as shown in FIG. 1A, so as to detect the opening of a window lock. The sensors 71, 72 in FIG. 1B may be of the same type, or may be of different types. For example, all of the sensors 71, 72 may be motion sensors, PIR sensors, or cameras. Alternatively, one sensor of sensors 71, 72 shown in FIG. 1B may be a motion sensor, and another sensor may be a camera.

In embodiments of the disclosed subject matter, where the window 100 may be covered and/or partially covered with a window treatment 108, sensors 71, 72 that are mounted adjacent to the window 100 may be motion sensors, and one or more other sensors may be mounted within a predetermined distance of the window 100, and may be, for example, cameras and/or motion sensors. The controller 73 may receive images captured from the camera and/or motion data captured form motion sensors, and may acquire data from the sensors 71, 72 mounted on the window 100. That is, the controller 73 may aggregate occupant motion data collected form the cameras and/or motion sensors with opening events detected by the sensors 71, 72 mounted on the window 100 in order to increase the accuracy of a window event detection from inside of the home or building. In some embodiments, the cameras may only capture image data when the security system is selectively configured to do so and/or identify persons.

FIG. 1C shows a side view of the window 100 shown in FIGS. 1A-1B. The window 100 may include window glass 114 and window frame 116. The sensors 71, 72 may be mounted in one or more positions on and/or adjacent to window 100, where a selected position may increase the ability of sensors 71,72 to detect a window opening event. For example, as discussed above in connection with FIG. 1A, the sensors 71, 72 may be mounted in vertical positions 102 and/or 104 (e.g., in either an upward-facing or downward-facing position), and/or in horizontal position 106. Mounting positions of sensors 71, 72 may be selected according to, for example, the size of the window 100 (e.g., the length, width, and height). For example, the mounting position 106 of sensors 71, 72 may be changed vertically according to a height of the window 100, and the positions 102 and/or 104 may be adjusted according to the width of the window 100. In embodiments of the disclosed subject matter, the sensors 71, 72 may increase accuracy of window opening event detection when mounted closer to the glass 114 within the frame 116 (e.g., in positions 102, 104). That is, according to the length, width, and height dimensions of the window 100, selection of mounting positions may be made to increase the accurate detection of window opening events.

In FIGS. 1A-1C, the sensors 71, 72 may be positioned, and/or selected according to type, and/or may be increased in number so as to detect how a home occupant opens the window from the inside. For example, the number, type, and position of the sensors may be selected so as to detect different speeds of an approach of a person to open the window. For example, some sensors may not be able to accurately detect a speed of movement above a predetermined level (e.g., a fast movement path to open a window). Accordingly, one or more sensors 71, 72 may be selected to detect different speeds of approach by a person to open a window. The sensors 71, 72 may also be able to detect a pause or stop in movement by the person in the approach to open a window. The approach by a person to open the window may include an angle and/or a path, where the path may be straight, curved, radial, and/or from a side.

In FIGS. 1A-1C, the types of windows in which sensors 71, 72 may be mounted on may include vertical sliding, horizontal sliding, casement, horizontal pivot, vertical pivot, transom, awning windows, and the like. The windows may have locks, which may be in a locked or unlocked state, which may be determined by the sensors 71, 72. The windows may be detected by the sensors 71, 72 as open, closed, or partially open.

A controller of a smart home system, such as a controller, may aggregate the data from the sensors disposed on and/or within a predetermined distance from the window to determine whether the window is being opened, and whether the window is being opened from the inside or outside. The controller may determine, for example, whether to output an alarm and/or notification message according to the aggregated sensor data, the mode that the security system is in (e.g., home mode, stay mode, away mode, vacation mode, or the like), and/or identifying information of the person opening the window. A security exception may be generated by the system, so that the system does not output an alarm and/or notification message, according to whether the window is opened from the inside or outside, the mode of the security system, and/or the identity of the person opening the window.

In some embodiments, even when a security exception is generated, the system may be configured to output an awareness notification. For example, the notification message may provide an option to launch an application with video (e.g., an application stored on a smartphone, tablet computer, or the like) of the affected room (e.g., where the window is detected to be open) that can be presented to the user. Alternatively, or in addition, the application may provide an option to output an audio and/or visual alarm, and/or call a security monitoring company or emergency response service (e.g., police department, fire department, or the like).

Figure 2:
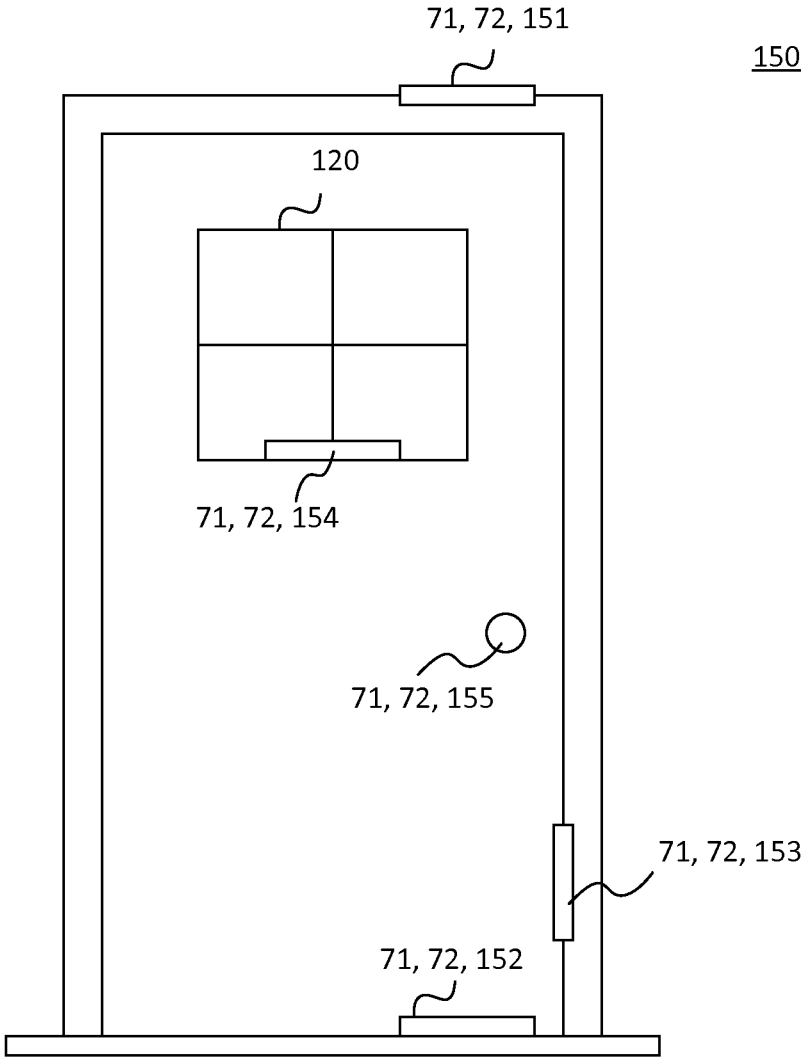
FIG. 2 shows example positions of door sensors according to an embodiment of the disclosed subject matter.

FIG. 2 shows example positions of door sensors according to an embodiment of the disclosed subject matter. The door sensors may be used to determine whether a door is being opened, and whether the door is being opened from the inside or the outside of the home or building. In some embodiments where a security system is selectively configured to detect an identity of a person, the door sensors shown in FIG. 2 may be used in combination with a camera sensor and/or a communication interface to determine the identity of the person opening the window (e.g., from image data captured from the person and/or identifying information from a device carried by the person). Such sensors may be disposed on the inside and/or outside of the door, or within a predetermined proximity to the door, on the inside and/or outside of the home or building having the door. That is, the camera and/or communication sensors may acquire images and/or data from a variety of suitable positions near the door. To more accurately detect the opening of a door, and the side (e.g., inside or outside) that the door is being open, FIG. 2 show examples of a different types and mounting locations of sensors to determine the opening of the window from the inside or outside.

As shown in FIG. 2, sensors 71, 72 maybe mounted on and/or adjacent to door 150. For example, as shown in FIG. 2 shows that sensors 71, 72 may be mounted in position 151, 152, and/or 153. That is, the sensors 71, 72 may be mounted in a vertical position 151 in a downward-facing position. Alternatively, or in addition, the sensors 71, 72 may be mounted in a vertical position 152 in an upward-facing position. Alternatively, or in addition, the sensors 71, 72 may be mounted in a horizontal position 153.

As shown in FIG. 2, the sensors 71, 72 may be mounted in position 155 to determine whether a door handle of the door 150 is turned and/or moved, and/or a lock of the door 150 is moved from a locked position to an unlocked position. The door 150 may include a window 120. For example, the window 120 of door 150 may not be openable. However, as shown in FIG. 2, the sensors 71, 72 may be mounted at position 154 to determine an intrusion event, such as the breaking of the window 120. Although sensors 71, 72 as shown in FIG. 2 as being mounted in positions 151, 152, 153, 154, and/or 155, these are merely example mounting positions, and the sensors 71, 72 may be mounted in any suitable locations for sensors 71, 72 are shown in FIG. 2, the door 150 may have one or more sensors to detect and opening event and/or an intrusion event. That is, the security system disclosed herein is not limited to the number of sensors shown in FIG. 2.

In FIG. 2, the sensors 71, 72 may be positioned, and/or selected according to type, and/or may be increased in number so as to detect how a home occupant opens the door from the inside. For example, the number, type, and position of the sensors should be selected so as to detect different speeds of an approach of a person to open the window. For example, some sensors may not be able to accurately detect a speed of movement above a predetermined level (e.g., a fast movement path to open a door). Accordingly, one or more sensors 71, 72 may be selected to detect different speeds of approach by a person to open a door. The sensors 71, 72 may also be able to detect a pause or stop in movement by the person in the approach to open a door. The approach by a person to open the door may include an angle and a path, where the path may be straight, curved, radial, and/or from a side.

In FIG. 2, the types of doors in which sensors 71, 72 may be mounted on may include sliding, French, double, single, pocket, storm, windowed doors, and the like. The doors may have locks, which may be in a locked or unlocked state, which may be determined by the sensors 71, 72. The sensors 71, 72 may also detect the movement of a door handle. The doors may be detected by the sensors 71, 72 as open, closed, or partially open.

Typically, unlike windows, doors may not have treatments. However, sliding doors (e.g., sliding glass doors) may have treatments, such as vertical blinds, drapes, and the like. As discussed above in connection with FIGS. 1A-1C, the number, type, and/or mounting position of the sensors 71, 72 may be selected so as to increase the detection of an interior or exterior opening event, and minimize the interference of the sensors 71, 72 by the treatments. Moreover, as discussed above in connection with FIGS. 1A-1C, the speed, path, and/or angle of an approach to open or close a door may be detected, and may be used to increase the detection of opening events and reduce errors.

A system controller may aggregate the data from the sensors disposed on and/or within a predetermined distance from the sensor to determine whether the door is being opened, and whether the door is being opened from the inside or outside. The controller may determine, for example, whether to output an alarm and/or notification message according to the aggregated sensor data, and/or the mode that the security system is in (e.g., home mode, stay mode, away mode, vacation mode, or the like) In some embodiments where the security system is selectively configured to identify a person, the controller may determine whether to output an alarm and/or notification message according identifying information of the person opening the door. A security exception as described above may be generated by the system, so that the system does not output an alarm and/or notification message, according to whether the door is opened from the inside or outside, the mode of the security system, and/or the identity of the person opening the door (e.g., when the system is selectively configured to do so).

In some embodiments, even when a security exception is generated, the system may be configured to output an awareness notification. For example, as discussed above, the notification message may provide an option to launch an application with video of the affected room that can be presented to the user. Alternatively, or in addition, the application may provide an option to output an audio and/or visual alarm, and/or call a security monitoring company or emergency response service (e.g., police department, fire department, or the like).

Figure 3A:
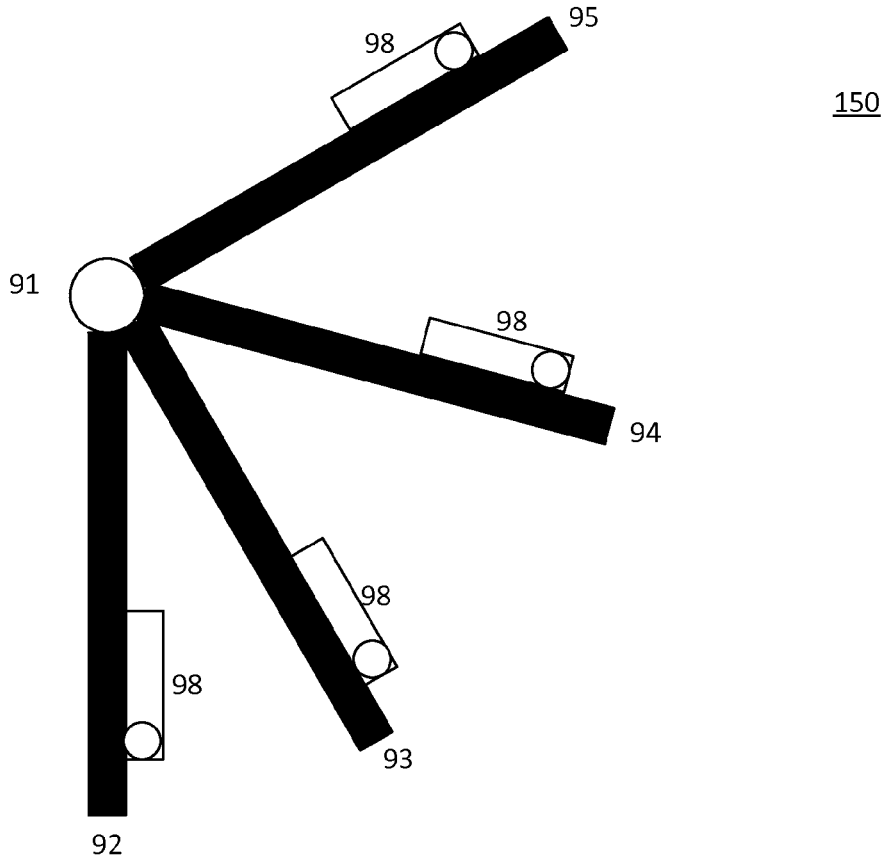
FIGS. 3A-3B show example sensors according to an embodiment of the disclosed subject matter.
Figure 3B:
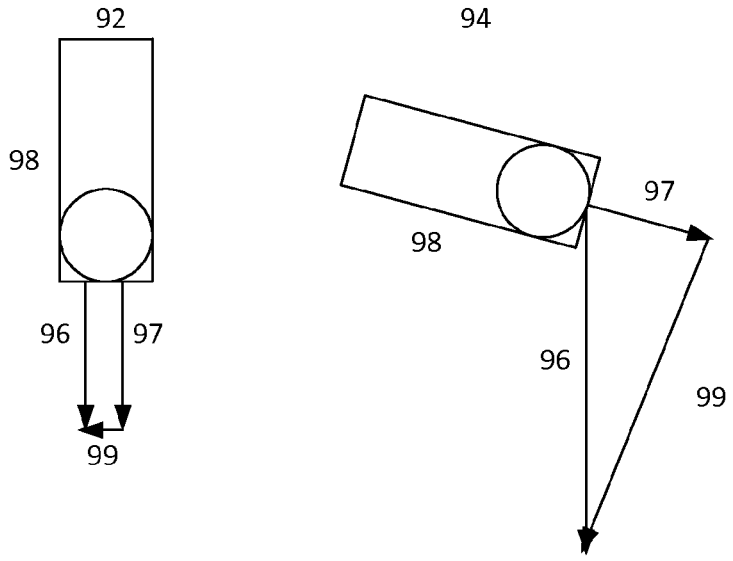

FIGS. 3A-3B show an example sensor 98 that can be mounted to the door 150 (e.g., where door 150 is shown in detail in FIG. 2 and described above). The sensor and its position as shown in FIGS. 3A-3B may be used to determine whether the door is being opened, and what side the door is being opened from (e.g., the inside or the outside). The sensor 98 may include an accelerometer and/or electronic compass which may detect movement and acceleration data, and may be used by the security system to determine whether the door is being open from the inside or the outside.

For example, the security system of the disclosed subject matter may employ a magnetometer affixed to a door jamb and a magnet affixed to the door. When the door is closed, the magnetometer may detect the magnetic field emanating from the magnet. If the door 150 is opened (e.g., an opening event), the increased distance may cause the magnetic field near the magnetometer to be too weak to be detected by the magnetometer. If the security system is activated (e.g., in a home mode, a stay mode, or away mode), it may interpret such non-detection as the door 150 being ajar or open. In some configurations, a separate sensor or a sensor integrated into one or more of the magnetometer and/or magnet may be incorporated to provide data regarding the status of the door. For example, an accelerometer and/or an electronic compass may be included in sensor 98, which is affixed to the door and indicate the status of the door and/or augment the data provided by the magnetometer. In some cases, a person on one side or the other of a door or window can cause the magnetic field near the door to change. This can happen, for example, if the person near a door is wearing a ferromagnetic item, such as a belt buckle or is carrying a device that emits an magnetic field. In such a case, a change in magnetic field orientation or strength indicated by a magnetometer oriented to sense toward one side of a door or another can be used as an indication of from which side the door is being opened. This indication can be combined with other indications from other sensors by controller to determine from which side a door is being opened.

FIG. 3A shows a schematic representation of an example of the door 150 that opens by a hinge mechanism 91. In the first position 92, the door is closed and the sensor 98 may indicate a first direction. The door may be opened at a variety of positions as shown 93, 94, 95. The fourth position 95 may represent the maximum amount the door can be opened. Based on the sensor 98 readings, the position of the door may be determined and/or distinguished more specifically than merely open or closed. In the second position 93, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

FIG. 3B shows a sensor 98 in two different positions, 92, 94, from FIG. 3A. In the first position 92, the electronic compass of the sensor 98 detects a first direction 96. The electronic compass's direction is indicated as 97 and it may be a known distance from a particular location. For example, when affixed to a door, the sensor 98 may automatically determine the distance from the door jamb or a user may input a distance from the doorjamb. The distance representing how far away from the door jamb the door is 99 may be computed by a variety of trigonometric formulas. In the first position 92, the door is indicated as not being separate from the door jamb (i.e., closed) 99. Although features 96 and 97 are shown as distinct in FIG. 3B, they may overlap entirely. In the second position 94, the distance between the door jamb and the door 99 may indicate that the door has been opened wide enough that a person may enter.

In some configurations, an accelerometer may be employed (e.g., as a part of sensor 98) to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as described in connection with FIGS. 5 and 8. The data may be analyzed to learn a user behavior, an environment state, and/or as a component of a home security, a home automation system, and/or the smart-home environment. The data may also be aggregated with other sensor data to determine whether the door is being opened, whether the door is being opened from the inside or the outside, and/or the identity of the person opening the door. The security system may generate a security exception (e.g., in which an alarm may not be output and/or a notification message may not be transmitted) according to the mode of the security system and/or whether the door is being opened from the inside or outside. In some embodiments, where the system is selectively configured to detect an identity of a person, the security system may generate a security exception according to the identity of the person opening the door (e.g., an exception is generated when the identified person is a registered user).

As discussed above, even when a security exception is generated, the system may be configured to output an awareness notification. For example, the notification message may provide an option to launch an application with video of the affected room that can be presented to the user. Alternatively, or in addition, the application may provide an option to output an audio and/or visual alarm, and/or call a security monitoring company or emergency response service (e.g., police department, fire department, or the like).

While the above example described in connection with FIGS. 3A-3B is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, etc. Data generated by one or more sensors (e.g., sensors 71, 72 and/or 98 discussed above) may indicate patterns in the behavior of one or more users and/or an environment state over time, and thus may be used to "learn" characteristics of the movement of occupants in a home or building, their use of doors or windows, the speed and path of approach of occupants for an opening event, and the like to increase the successful detection of opening events and minimize false activations of the alarm device. This learned data may be aggregated, and may be used by the security system to generate a security exception, where a pattern of movement in opening a door or window is recognized as being that of a registered used (e.g., an occupant of the home). As discussed throughout, when a security exception is generated, the system may refrain from outputting an alarm and/or notification message.

Figure 4A:
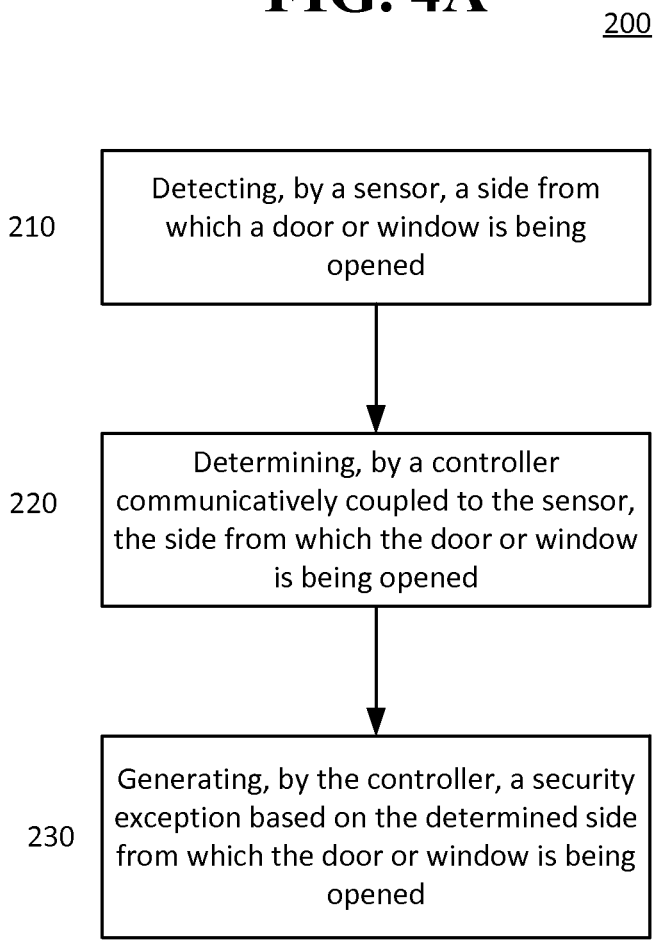
FIGS. 4A-4B show example methods of detecting a door or window opening in a building according to an embodiment of the disclosed subject matter.

FIG. 4A shows an example method 200 of detecting a side from which a door or window is being opened in a home or building according to an embodiment of the disclosed subject matter. The method may include detecting, by a sensor, a side from which a door (e.g., door 150 shown in FIG. 2) or window (e.g., window 100 shown in FIGS. 1A-1C) is being opened at operation 210. At operation 220, a controller (e.g., controller 73, device 20, and/or remote system 74 as shown in FIGS. 5-8 and discussed below) that is communicatively coupled to the sensor (e.g., sensor 71, 72, 98 of FIGS. 1A-1C, and 3A-3B) may determine the side from which the door or window is being opened. The method may include generating, by the controller, a security exception based on the determined side from which the door or window is being opened at operation 230.

The security exception of the method may include an action, such as refraining from outputting a control signal to an alarm device, refraining from outputting a notification message to a device communicatively coupled to the controller, and changing an operating mode of a security system. In some embodiments, the security exception may be generated by the controller when it determines that the door or window is being opened from inside of the building or home. The method may include transmitting, by the controller, a notification message to a device to be displayed that the door or window is being opened from the inside.

Figure 4B:
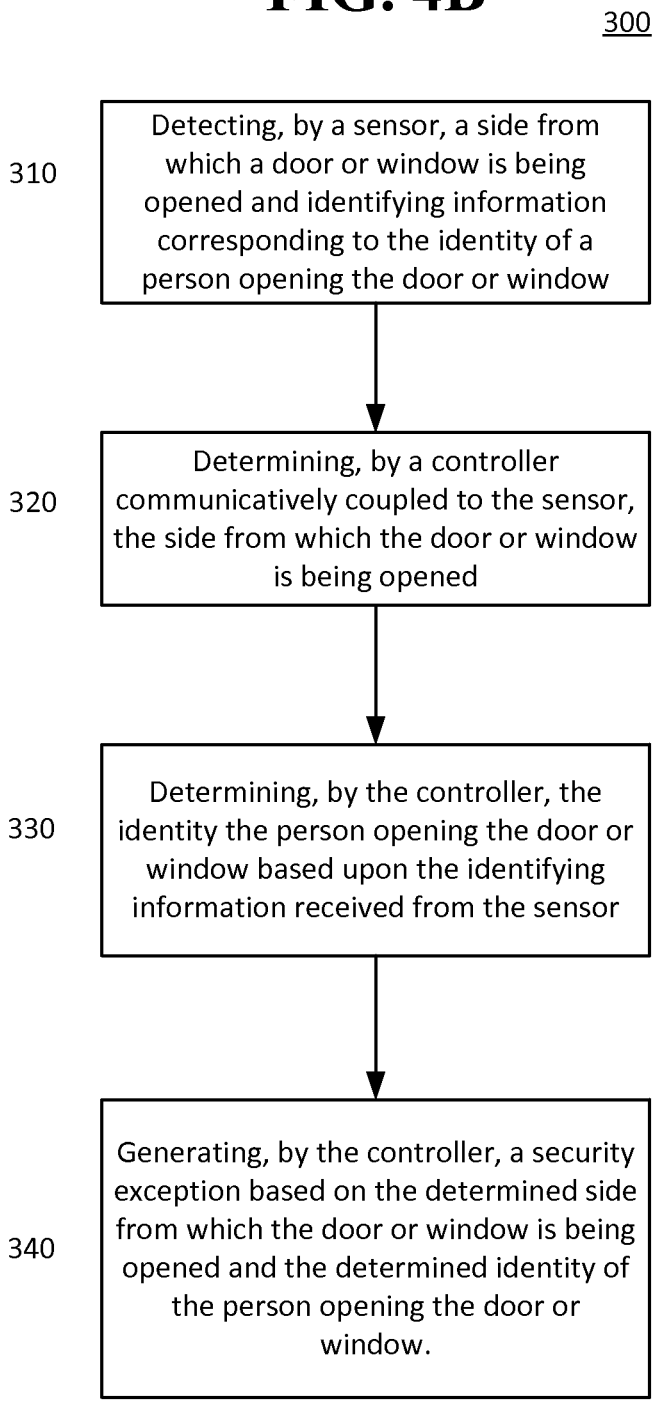

FIG. 4B shows an example method 300 of detecting a side from which a door or window is being opened in a home or building, and the identity of a person opening the door or window according to an embodiment of the disclosed subject matter. That is, method 300 shown in FIG. 4B is similar to the method 200 shown in FIG. 4A, but determines the identity of the person, for example, when the security system is selectively configured to do so. A sensor (e.g., sensor 71, 72, 98 of FIGS. 1A-1C, and 3A-3B) may detect a side from which a door (e.g., door 150 shown in FIG. 2) or window (e.g., window 100 shown in FIGS. 1A-1C) is being opened on a home or building in operation 310. For example, the sensor may determine whether the window or door is opened from the inside or the outside of the home or building. The sensor may determine the motion of the door or window, and may include motion sensors and/or cameras to determine whether the person is inside or outside of the building, so as to determine whether the door or window is being opened from the inside or the outside. In operation 310, the sensor may capture identifying information of a person opening the door or window. For example, the sensor may be a camera which captures image data of the person that may be used to identify the person.

In operation 320, a controller (e.g., controller 73, device 20, and/or remote system 74 as shown in FIGS. 5-8 and discussed below) that is coupled to the sensor the side from which the door or window is being opened. That is, the controller may use, for example, the motion data from the sensor and/or image data from the sensor to determine where a person is present that may be opening the door or window.

In operation 330, the controller may determine the identity the person opening the door or window based upon information received from the sensor. For example image data or other identifying information from the sensor may be used to determine the identity of the person opening the door or window.

The controller may generate a security exception based on the determination of the side from which the door or window is being opened and the determined identity of the person opening the door or window at operation 340.

In embodiments of the disclosed subject matter, the method may include generating the security exception with the controller, which may include refraining from outputting a control signal to an alarm device. For example, when the person identified by the controller is an authorized user, the controller may refrain from outputting a control signal to an alarm device. In another example, the person identified may be inside the home or building to open the door or window, and the controller may refrain from outputting the control signal to the alarm device.

The controller may generate the security exception so as to refrain from outputting a notification message to a device communicatively coupled to the controller. For example, when the system is selectively configured to provide identification of persons, and the person identified by the system is an authorized user, the system may refrain from outputting a notification message to a device of the user (e.g., a message notifying the user that a window or door has been opened, where the message is transmitted a smartphone, a wearable computing device, or the like). In another example, the person identified may be inside the home or building to open the door or window, and the controller may refrain from outputting the notification message. As discussed above, even when a security exception is generated, the system may be configured to output an awareness notification. That is, the notification message may provide an option to launch an application with video of the affected room that can be presented to the user. Alternatively, or in addition, the application may provide an option to output an audio and/or visual alarm, and/or call a security monitoring company or emergency response service.

The controller may generate the security exception so as to change an operating mode of a security system. For example, an operating mode of the security system can be changed from a vacation mode or an away mode to a home mode when the controller generates the security exception. In some embodiments, when the system is selectively configured to identify a person, the operating mode of the security system can be changed from a vacation mode or an away mode to a home mode when the controller generates the security exception when the captured identifying information is from the registered user. That is, when the security system identifies the user as an authorized user of the security system according to the captured identifying information, the controller can change the operating mode so as to reduce the level of security to allow the user to open the door or window, and reduce the activation of an unwanted alarm. This may also improve the user experience of the security system, as the security system may automatically adjust the operating modes so that the user can open the door or window without setting off an alarm, and without the user having a limited time period to manually adjust the operation before an alarm is activated.

The controller may change the operation mode of the security system from a first operating mode to a second operating mode, and may dispatch an alarm when the identified person entered the building through the door in the first operating mode. The controller may not dispatch the alarm when the identified person entered the building through the door in the second operating mode.

In embodiments of the disclosed subject matter, the method may include capturing an image of the person with a camera of the sensor, for example, when the system is selectively configured to determine an identity of a person. The controller may compare the captured image data with a pre-stored image data. From this comparison, the controller may determine the identity of the person. For example, if at least a portion of the captured image data is the same as the pre-stored image data, the identity of the person may be determined. In this example, the pre-stored image data may be image data from authorized users of the security system, occupants of a home, or persons authorized to be in a building. The controller may determine the identity of the person from this comparison, and generate a security exception based on the determined identity.

For example, if the controller determines the identity of the person is someone who is an occupant of the home, the security system may generate a security exception so that when a door or window is opened by the identified person, the security system refrains from outputting an alarm and/or sending a notification, and/or may change the operational state of the security system, as described above.

In embodiments of the disclosed subject matter, the method may include identifying information from a device carried by the person (e.g., a smartphone, wearable computing device, key FOB, RFID device, fitness band, or the like) by using a sensor and/or communication interface to acquire the identifying information. The controller of the security system may compare the captured identifying information with pre-stored identifying information. The controller may determine the identity of the person based on the comparison, and may generate the security exception based on the determined identity of the person.

The security exception may be generated by the controller when the controller determines that the door or window is being opened from inside of the building. For example, a notification message to a device (e.g., a smartphone, a wearable computing device, and the like) to be displayed that the door or window is being opened from the inside. The content of the transmitted notification message may be based on the determined identity of the person. For example, when the identity of the person is determined to be an authorized user and/or occupant of the home or building (e.g., the homeowner), the notification message may include the location of the door or window that is being opened, the time and day of the opening, and the identify and/or identifying information of the person opening the door or window.

Embodiments of the security system of the smart-home environment disclosed herein, such as shown in FIG. 1, may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 5:
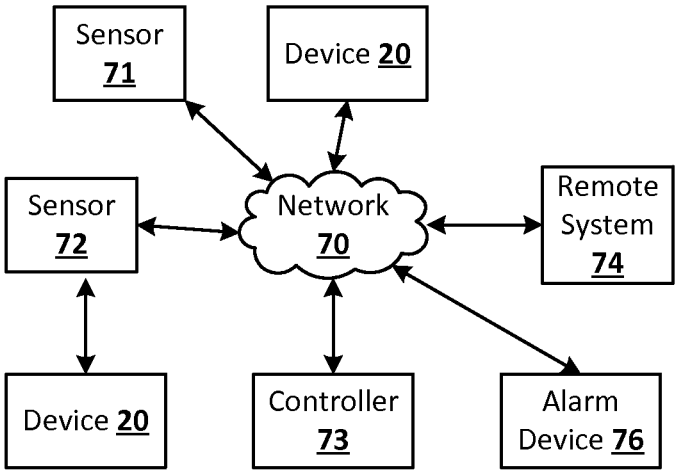
FIG. 5 shows a security system according to embodiments of the disclosed subject matter.

FIG. 5 shows an example of a smart-home environment and/or security system as disclosed herein, which may be implemented over any suitable wired and/or wireless communication networks. As discussed above, the security system of this smart home environment may determine whether a door or window of a home or building is being opened from the inside or outside, may identify the person opening the door or window, and may generate a security exception to avoid unwanted alarms and/or notifications. The system may include network 70, sensors 71, 72, controller 73, remote system 74, alarm device 76, and device 20, and the like. That is, the sensors 71, 72, controller 73, remote system 74, alarm device 76, and device 20 may be communicatively coupled to one another via the network 70. As shown in FIG. 5, device 20 may be communicatively coupled to the sensor 72 and/or may be directly coupled to the network 70.

The sensors 71, 72 may communicate via the local network 70, such as a Wi-Fi or other suitable network, with each other and/or with the controller 73. The devices of the security system and smart-home environment of the disclosed subject matter (e.g., as shown in FIG. 5) may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensors 71, 72, which are generally described above, may detect movement of the user within a home or building. The data detected by the sensors 71, 72 may be aggregated to accurately determine an opening event of a door or window. In embodiments of the disclosed subject matter, the sensor 71, 72 may be a camera and/or motion sensor (e.g., which may include an accelerometer and/or electronic compass, or the like) to capture an image (e.g., when the system is selectively configured to identify a person) and/or movement of an occupant, which may be correlated with other data acquired from sensors 71, 72, to determine whether a window or door is being opened from inside of the home or building, or from the outside. For example, when the camera of sensors 71, 72 captures one or more images of an occupant and/or senses the motion of the occupant of the home near a window, and one or more sensors 71, 72 disposed near a window may determine an opening event, the controller 73 may determine the window opening event was initiated by the occupant, and the controller 73 controls the alarm device 76 to refrain from activating an alarm.

The sensors 71, 72 may, when the system is selectively configured, acquire identifying information from a person opening the door or window. For example, the sensors 71, 72 may include a camera to capture image data of a person opening the door or window, and/or may include a communication interface or the like to capture identifying information from a device that is within the person's possession (e.g., a smartphone, wearable computing device, key FOB, RFID device, and the like).

The controller 73 shown in FIG. 5 may be communicatively coupled to the network 70 and/or may include a processor. Alternatively, or in addition, the controller 73 may be a general—or special—purpose computer. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors 71, 72 may communicate directly with a remote system 74. The remote system 74 may, for example, aggregate data from multiple locations, provide instruction, software updates, and/or aggregated data to a controller 73 and/or sensors 71, 72.

The controller 73 may aggregate detection data from the sensors 71, 72 and store it in a storage device coupled to the controller 73 or the network 70. The data aggregated by the controller 73 may be used to determine entrance and exit patterns (e.g., what days and times users enter and exit from the house, what doors are used, and the like) of the members of the household, and the controller 73 may arm or disarm the alarm device 76 according to the determined patterns. Alternatively, or in addition, the controller 73 may aggregated data detected by the sensors 71, 72 to determine whether a window or door is being opened, and/or the identity of the person opening the door or window.

The data aggregated by the system and stored may be configured and/or transformed so that the one or more users, occupants, or the like for which data is aggregated may be anonymous. That is, in some embodiments, the user may select that the security system transform the collected data so as to make the identity of a person anonymous, and/or any detected behavior (e.g., days and times that a person leaves or enters a home, or the like) be anonymous.

The controller 73 may generate a security exception according to whether the door is being opened from the inside or outside, the operation mode of the security system (e.g., home, stay, away, vacation, or the like), and the identity of the person opening the door or window. The generated security exception may refrain from outputting at alarm and/or notification message, and thus the number of unwanted alarms and/or notifications may be minimized. As discussed above, even when a security exception is generated, the system may be configured to output an awareness notification. That is, the notification message may provide an option to launch an application with video of the affected room that can be presented to the user. Alternatively, or in addition, the application may provide an option to output an audio and/or visual alarm, and/or call a security monitoring company or emergency response service.

The security system and/or smart-home environment shown in FIG. 5 includes the remote system 74. In embodiments of the disclosed subject matter, the remote system 74 may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised, a message may be transmitted to the remote system 74 associated with local law enforcement to provide assistance with the security event (e.g., request a police department response to the security event).

The security system as disclosed herein and shown in FIG. 5 may include an alarm device 76, which may include, for example, a light and an audio output device. The alarm device 76 may be controlled, for example, by controller 73. The light of the alarm device 76 may be activated so as to be turned on when one or more sensors 71, 72 detect a security event and/or an environmental event. Alternatively, or in addition, the light may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, an audio output device of the alarm device 76 may include at least a speaker to output an audible alarm when a security event and/or an environmental event is detected by the one or more sensors 71, 72.

In embodiments of the disclosed subject matter, the controller 73 may control the alarm device 76 to be activated (e.g., output an audio and/or visual alarm) when a security event is detected, such as an opening and/or forced entry of a door or window of a home or building is detected. The controller 73 may refrain from outputting a control signal to the alarm device 76 and/or transmitting a notification message to a device 20 when a detected event by the sensors 71, 72 is determined to be an opening of a door or window from the inside, and/or an opening of the door or window by an identified person (e.g., a person identified according to image data and/or identifying information from a device that may be registered with the security system).

As shown in FIG. 5, the device 20 may be communicatively coupled to the network 70 so as to exchange data, information, and/or messages with the sensors 71, 72, the controller 73, and the remote system 74. For example, the device 20 may receive notifications from the security system when an opening of a door or window occurs, the location of the door or window, and the identity and/or image of the person opening the door or window.

Figure 7:
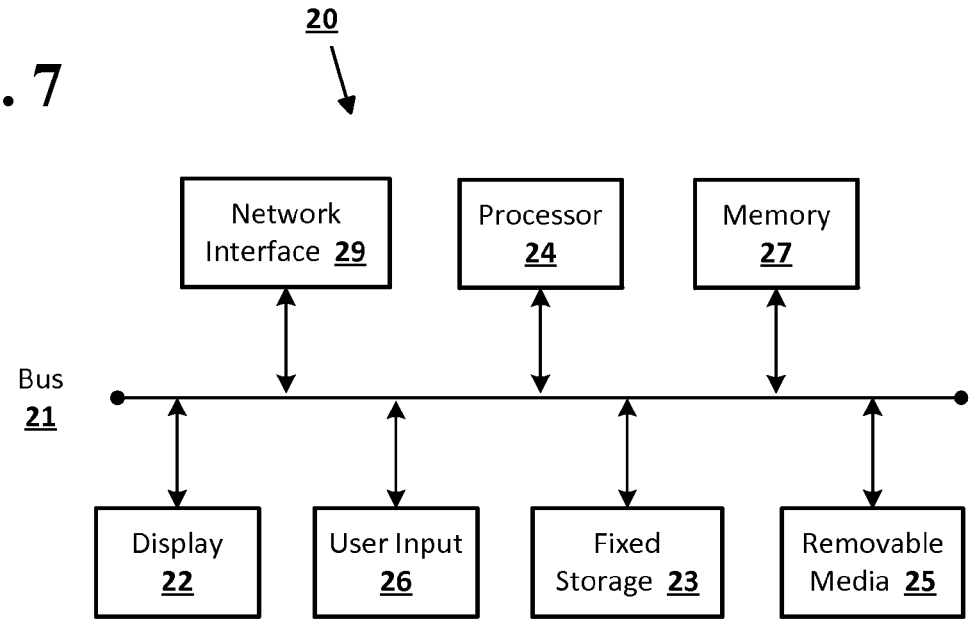
FIG. 7 shows a computing device according to an embodiment of the disclosed subject matter.

The security system of the disclosed subject matter, as shown in FIG. 5, may include a device 20 that may be communicatively coupled to a sensor. Although FIG. 5 illustrates that device 20 is coupled to sensor 72, the device 20 may be communicatively coupled to sensor 71 and/or sensor 72. The device 20 may be a computing device as shown in FIG. 7 and described below. A user of the security system disclosed herein may control the device 20. When the device 20 is within a predetermined distance (e.g., one foot, five feet, 10 feet, 20 feet, 100 feet, or the like) from the sensor 72, the device 20 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. The device 20 may provide identifying information to the sensor 72, which may be provided to the controller 73 to determine whether the device 20 belongs to an authorized user of the security system disclosed herein. The controller 73 may monitor the location of the device 20 in order to determine whether to change an operating mode of the alarm device 76 (e.g., a home mode, a stay mode, and away mode, a vacation mode, or the like). The security system shown in FIG. 5 may detect the location of the device 20, and may correlate the detected motion of the device 20 (e.g., as being carried by an occupant of the home or building) with a detected event (e.g., an opening of a door or window, or the like) when the detected motion is within a predetermined area from the detected event. That is, the security system disclosed herein may use the detected location and/or motion of the device 20 to determine whether the detected event (e.g., the opening of the window or door) is by an occupant (e.g., according to the movement of the occupant and/or the device 20, and the detection by the sensors 71, 72 from inside the home or building). As discussed throughout, the security system may be selectively configured to acquire identifying information from the device 20, so that a person opening the door or window can be identified, and a security exception may be generated, so as to reduce the number of unintended alarms and/or notifications.

In some selective configurations of the security system, when the sensor 72 and/or the controller 73 determine that the device 20 is associated with an authorized user according to the transmitted identification information, the sensor 72 and/or the controller 73 provide an operational status message to the user via a speaker (i.e., audio output of alarm device 76), a display (e.g., where the display is coupled to the controller 73 and/or remote system 74), and/or the device 20. The operational status message displayed can include, for example, a message that a security event (e.g., a window or door has been opened) and/or environmental event has occurred. When the sensors 71, 72 have not detected a security and/or environmental event, a message may be displayed that no security and/or environmental event has occurred. In embodiments of the subject matter disclosed herein, the device 20 may display a source of the security event and/or environmental event, a type of the security event and/or environmental event, a time of the security event and/or environmental event, and a location of the security event and/or environmental event. In some embodiments, the system may refrain from transmitting a status message when a window or door is opened according to the operating mode of the security system, whether the door or window is opened from the inside or outside, and the identity of the person opening the door or window. The system may generate a security exception to refrain from transmitting the status message.

The sensor network shown in FIG. 5 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like). One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 5 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 5.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 5, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 5 and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 5 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 5. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 71, 72 may detect the power and/or speed of a fan, and the controller 73 may adjust the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 5. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed. As disclosed herein, the smart entry detectors may determine whether a window or door is open from the inside or outside, and/or may determine the identity of the person opening the door or window.

The smart-home environment of the sensor network shown in FIG. 5 can include one or more intelligent, multi-sensing, network-connected doorknobs (e.g., "smart doorknob"). For example, the sensors 71, 72 may be coupled to a doorknob of a door (e.g., at position 155 of door 150 shown in FIG. 2, and/or located on external doors of the structure of the smart-home environment). However, it should be appreciated that smart doorknobs can be provided on external and/or internal doors of the smart-home environment. As disclosed herein, the smart doorknob may determine whether a door is open from the inside or outside. For example, the smart doorknob may sense which side of the door a person is opening the door from (e.g., according to which side of the doorknob a person is grasping to turn the doorknob, or the like).

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 5 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, smart watch, wearable computing device, a tablet, radio frequency identification (RFID) tags, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device (e.g., device 20, as shown in FIGS. 5 and 7, and discussed in detail below). In some examples, some or all of the users (e.g., individuals who live in the home) can register their mobile device and/or key FOBs with the smart-home environment (e.g., with the controller 73). When the security system is selectively configured, image data of the users or other authorized persons may be stored by the security system so that captured image data from the sensor may be compared with the stored image data of the registered users. Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As discussed above, the security system may be configured so that individuals remain anonymous, and that personal data is only transmitted to a remote system by selectively opting to do so. When the system is selectively configured, captured image data may be used and/or stored by the smart-home environment to learn which individuals are authorized to be in the home or building, and/or to open door or window (e.g., so as to create a security exception, based on their identity). As such, the smart-home environment may "learn" who is a user (e.g., an authorized user), and/or may permit the electronic devices associated with those individuals to control the network-connected smart devices of the smart-home environment (e.g., devices communicatively coupled to the network 70), in some embodiments including sensors used by or within the smart-home environment.

In the smart-home environment, various types of notices and other information may be provided to users via messages sent to one or more user electronic devices (e.g., device 20). For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

Figure 6:
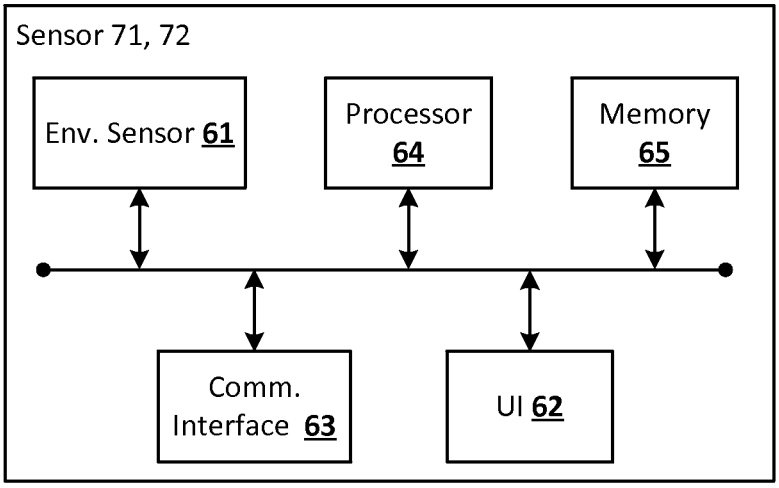
FIG. 6 shows an example sensor according to an embodiment of the disclosed subject matter.

The sensor 71, 72, as shown in FIG. 5, may include hardware in addition to the specific physical sensor that obtains information about the environment. FIG. 6 shows an example sensor as disclosed herein. The sensors 71, 72 may include an environmental sensor 61, such as a temperature sensor, smoke sensor, carbon monoxide sensor, motion sensor, accelerometer, proximity sensor, camera sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensors 71, 72 is located. A processor 64 may receive and analyze data obtained by the sensor 61, control operation of other components of the sensor 71, 72, and process communication between the sensor and other devices. The processor 64 may execute instructions stored on a computer-readable memory 65. The memory 65 or another memory in the sensor 71, 72 may also store environmental data obtained by the sensor 61. A communication interface 63, such as a Wi-Fi or other wireless interface, Ethernet or other local network interface, or the like may allow for communication by the sensors 71, 72 with other devices. A user interface (UI) 62 may provide information and/or receive input from a user of the sensor. The UI 62 may include, for example, a speaker to output an audible alarm when an event is detected by the sensors 71, 72. Alternatively, or in addition, the UI 62 may include a light to be activated when an event is detected by the sensors 71, 72. The user interface may be relatively minimal, such as a liquid crystal display (LCD), light-emitting diode (LED) display, or limited-output display, or it may be a full-featured interface such as a touchscreen. Components within the sensors 71, 72 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Embodiments of the presently disclosed subject matter may be implemented in and used with a variety of computing devices. FIG. 7 as an example computing device 20 suitable for implementing embodiments of the presently disclosed subject matter. The computing device may be the device 20 illustrated in FIG. 5 and discussed above. The device 20 may be used to implement a controller, a device including sensors as disclosed herein, or the like. Alternatively or in addition, the device 20 may be, for example, a desktop or laptop computer, or a mobile computing device such as a smart phone, tablet, key FOB, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIG. 5. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Figure 8:
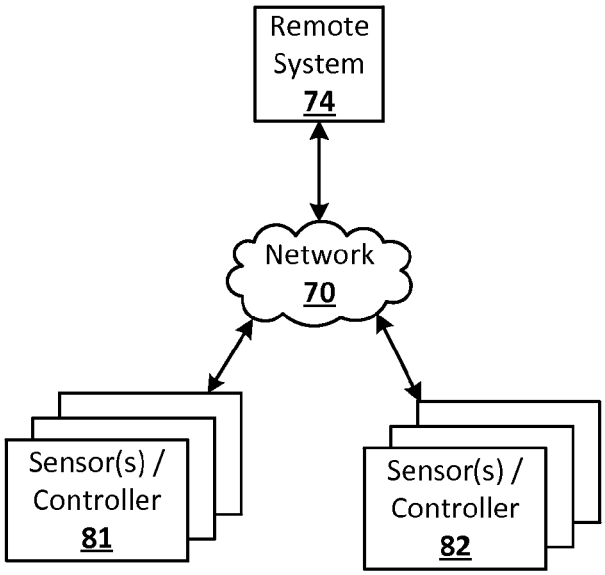
FIG. 8 shows a remote system to aggregate data from multiple locations having security systems according to an embodiment of the disclosed subject matter.

As shown in FIG. 8, a remote system 74 may aggregate data from multiple locations, such as multiple buildings, multi-resident buildings, individual residences within a neighborhood, multiple neighborhoods, and the like. In embodiments of the disclosed subject matter, unless a user of the security system actively configure the system so as to transmit identification information and/or other personal data, such data may not be transmitted and/or aggregated so as to be provided to the remote system 74.

In general, multiple sensor/controller systems 81, 82 as previously described with respect to FIG. 5 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's image and/or a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A security system comprising:

a first sensor to detect a side from which a door or window is being opened based on detected first data while the security system is in a first operating mode;

a second sensor to confirm the detected side from which the door or window is being opened based on detected second data; and a controller communicatively coupled to the first sensor and the second sensor to determine the side from which the door or window is being opened based on aggregation of the first and second data, and to generate a security exception based on a time of day and based on the determination of the side from which the door or window is being opened while the security system is in the first operating mode without altering the first operating mode.

2. The system of claim 1, wherein the security exception generated by the controller includes an action selected from the group consisting of: the controller refrains from activating an alarm device, the controller refrains from sending a notification message to a device communicatively coupled to the controller, and the controller changes the first operating mode to a second operating mode.

3. The system of claim 1, wherein the sensor captures image data of a person, the controller compares data based on the captured image with a pre-stored image data, determines the identity of the person and generates the security exception based on the determined identity.

4. The system of claim 1, wherein the sensor captures identifying information from a device carried by a person, the controller compares the captured identifying information with pre-stored identifying information, determines the identity of the person based on the comparison and generates the security exception based on the determined identity of the person.

5. The system of claim 1, wherein the controller determines that the door or window is being opened from inside and the controller generates the security exception based on the determination that the door or window is being opened from inside.

6. The system of claim 2, wherein the sensor captures identifying information of a person opening the door or window, and wherein the controller determines the identity the person opening the door or window based upon information received from the sensor, and generates the security exception based on the determined identity of the person opening the door or window.

7. The system of claim 4, wherein the device is selected from a group consisting of: a smartphone, a wearable computing device, a tablet computer, a laptop computer, an electronic fitness band, a key FOB, and an RFID device.

8. The system of claim 5, wherein the controller sends a notification message identifying the door or window is being opened and the side from which it is being opened.

9. The system of claim 6, wherein controller determines that the door is being opened from the outside by an authorized user and changes the first operating mode from a vacation mode or an away mode to the second operating mode of a home mode.

10. The system of claim 6, wherein the controller changes the first operating mode to the second operating mode, wherein an alarm would be dispatched when the identified person entered the building through the door in the first operating mode and an alarm would not be dispatched when the identified person entered the building through the door in the second operating mode.

11. The system of claim 6, wherein the controller changes the operating mode from the first operating mode to the second operating mode, wherein an alarm would not be dispatched when the identified person entered the building through the door in the first operating mode and an alarm would be dispatched when the identified person entered the building through the door in the second operating mode.

12. The system of claim 8, wherein a content of the transmitted notification message is based on an identity of a person that is determined by the controller based upon information received from the sensor when the door or window is opened.

13. A method performed in a security system in a first operating mode, the method comprising:

detecting, by a first sensor, a side from which a door or window is being opened based on detected first data;

confirming, by a second sensor, the detected side from which the door or window is being opened based on detected second data;

determining, by a controller communicatively coupled to the first sensor and the second sensor, the side from which the door or window is being opened based on aggregation of the first and second data; and generating, by the controller, a security exception based on a time of day and based on the determined side from which the door or window is being opened without altering the first operating mode of the security system.

14. The method of claim 13, wherein the security exception includes an action selected from the group consisting of: refraining from outputting a control signal to an alarm device, and refraining from outputting a notification message to a device communicatively coupled to the controller, and changing the first operating mode to a second operating mode.

15. The method of claim 13, further comprising:

capturing, by the sensor, an image of the person; and comparing, by the controller, data based on the captured image with a pre-stored image data;

determining, by the controller, the identity of the person; and generating the security exception based on the determined identity.

16. The method of claim 13, further comprising:

capturing, by the sensor, identifying information from a device carried by the person; and comparing, by the controller, the captured identifying information with pre-stored identifying information; and determining, by the controller, the identity of the person based on the comparison, wherein the security exception is generated based on the determined identity of the person.

17. The method of claim 13, wherein the security exception is generated by the controller when the controller determines that the door or window is being opened from inside of the building.

18. The method of claim 14, further comprising:

determining, by the controller, the identity the person opening the door or window based upon identifying information received from the sensor, wherein the detecting by the sensor includes detecting the identifying information corresponding to the identity of a person opening the door or window, and wherein the generating the security exception is based on the determined identity of the person opening the door or window.

19. The method of claim 17, further comprising:

transmitting, by the controller, a notification message to a device to be displayed that the door or window is being opened from the inside.

20. The method of claim 18, wherein the first operating mode is changed from vacation mode or an away mode to the second operating mode of a home mode when the controller generates the security exception and when the captured identifying information is from a registered user.

21. The method of claim 18, further comprising:

changing, by the controller, the first operating mode to the second operating mode; and dispatching an alarm when the identified person entered the building through the door in the first operating mode and not dispatching the alarm when the identified person entered the building through the door in the second operating mode.

22. The method of claim 19, wherein a content of the transmitted notification message is based on an identity of a person that is determined by the controller based upon information received from the sensor when the door or window is opened.

* * * * *